United States Patent [19]

Däster

[11] 4,075,773

[45] Feb. 28, 1978

[54] SHEET-SUPPORTING DEVICE

[76] Inventor: Oskar Däster, Oltnerstrasse 125, 4663 Aarburg, Switzerland

[21] Appl. No.: 574,714

[22] Filed: May 5, 1975

[30] Foreign Application Priority Data

May 9, 1974 Switzerland ..... 6468/74

[51] Int. Cl.[2] ..... G09F 3/18

[52] U.S. Cl. ..... 40/11 R; 24/67 R; 248/273

[58] Field of Search ..... 40/11, 10 R, 152.1, 40/23 R; 248/469, 473, 452, 453; 24/137 R, 67 R

[56] References Cited

U.S. PATENT DOCUMENTS

| | | | |
|---|---|---|---|
| 286,332 | 10/1883 | Ruffani | 40/11 R |
| 774,036 | 11/1904 | Burgess | 40/11 R |
| 1,502,274 | 7/1924 | Scott | 24/137 R |
| 1,681,586 | 8/1928 | Kessler | 248/473 |
| 2,206,775 | 7/1940 | Hoofer | 40/11 R X |
| 2,717,463 | 9/1955 | Sindler | 40/11 R X |
| 2,832,176 | 4/1958 | Vergeer | 248/473 X |
| 3,014,295 | 12/1961 | Aitkens | 40/11 R |
| 3,041,761 | 7/1962 | Knox | 40/152 |
| 3,325,929 | 6/1967 | Mauchline | 40/11 R |

FOREIGN PATENT DOCUMENTS

| | | | |
|---|---|---|---|
| 650,290 | 9/1937 | Germany | 40/11 R |

*Primary Examiner*—Russell R. Kinsey
*Assistant Examiner*—Wenceslao J. Contreras
*Attorney, Agent, or Firm*—Michael J. Striker

[57] ABSTRACT

A device for interchangeably supporting sheets in an upright position, particularly for displaying menu cards and the like, comprises interconnected wall portions defining a socket for one or more sheets. The wall portions have mutually inclined sheet-contacting surfaces which flex an inserted sheet and increase its rigidity in the longitudinal direction of the flexure.

7 Claims, 7 Drawing Figures

SHEET-SUPPORTING DEVICE

BACKGROUND OF THE INVENTION

The present invention relates to a sheet-supporting device, and more particularly to a display device for interchangeably supporting flexible sheets in an upright position.

In the prior art, card-display holders and menu stands do not adequately support an inserted flexible sheet in an upright manner.

The typical prior art support structure only loosely and weakly supports the flexible sheets inserted therein. At best, the lack of stiffness or flexibility of the sheets results in their drooping over the sides of the support so that direct viewing of printed matter or other information on the sheets is impossible.

Other prior art approaches involve clamping the sheets in place so rigidly that both hands of a viewer are needed to withdraw the sheet from the support. This aspect is particularly undesirable in the catering or restaurant industry where a display device should permit rapid and effortless insertion, removal or shuffling of sheets.

SUMMARY OF THE INVENTION

Accordingly, it is a general object of the present invention to overcome the disadvantages of the prior art.

More particularly, it is an object of the present invention to provide a display device which reliably supports flexible sheets in an upright position.

Another object of the present invention is to prevent the drooping of the flexible sheets over the sides of the support so that direct viewing will be possible.

A further object of the present invention is to firmly support flexible sheets and still provide for their quick interchangeability.

An additional object of the present invention is to provide an economical display device which requires little space.

In keeping with these objects and others which will become apparent hereinafter, one feature of the invention resides in the provision of interconnected wall portions which define a socket having an open top. The wall portions have mutually inclined sheet-contacting surfaces which flex an inserted sheet and increase the rigidity thereof in the longitudinal direction of the flexure.

This feature overcomes the prior art drawback of insufficiently supporting a flexible sheet, because the stiffness or rigidity of the sheet has been increased by its flexed or deformed configuration. The linear contact of the edge of the sheet of the prior art has been replaced by a curvilinear sheet edge which provides a substantially firmer base. The free-standing sheet can now be directly viewed since it is maintained in a substantially upright position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
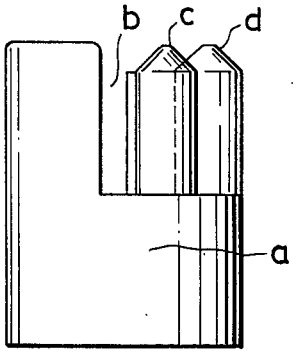
FIG. 1 is a side elevational view of a device embodying one form of the present invention.
Figure 2:
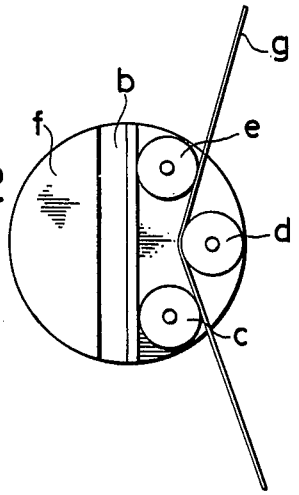
FIG. 2 is a top plan view of the device shown in FIG. 1.

Discussing the embodiment which has been illustrated in FIGS. 1 and 2, the reference characters *c, d* and *e* identify wall portions which constitute cylindrically shaped members having sheet-contacting surfaces defining a socket on their respective outer circumferential surfaces. The members *c, d, e* extend upwardly from and are mounted on a cylindrical base or pedastal *a*.

The sheet-contacting surfaces of members *c* and *e* are located at one side of the socket; whereas, the sheet-contacting surface of the facing or opposing members *d* is located at the other side of the pocket.

As more clearly shown in FIG. 2, the sheet-contacting surface of opposing members *d*, i.e., the portion of its outer circumferential surface facing the contact surfaces of the members *c* and *e*, is located inwardly of their common plane; that is, as viewed in the direction from the projection *d* towards the projections *c* and *e* (from right to left in FIG. 2).

This particular orientation of the wall portions forms a socket or passage for receiving a flexible sheet *g*. The sheet *g* is inserted into the socket intermediate the inclined sheet-contacting surfaces of the wall portions and is thereby constrained to assume an arcuate flexed configuration.

The base *a* has a curved display surface for exhibiting display material, e.g., advertising matter.

Additional wall portions define a straight channel *b* for receiving objects which may but need not be less flexible than a sheet *g*.

Portion *f* is shown non-utilized in this embodiment; however, it will be understood that portion *f* can be formed for further utilitarian purposes. For example, another set of wall portions defining a socket for receiving one or more sheets could be provided at this portion.

The profile of a socket, when observed from above, should not be such that a flexible sheet would necessitate creasing prior to insertion into the socket. Furthermore, the socket may be configurated in such a way that it causes multiple flexing of an inserted sheet. For example, the base *a* of the device shown in FIGS. 1 and 2 could have a fourth cylindrical member in line with the members *c* and *e* (e.g., adjacent to but spaced from the member *c*) and a fifth cylindrical member in line with the member *d* (so as to be positioned, with respect to the member *c* and the fourth member, in the same way as the member *d* is positioned with respect to the members *c* and *e*). This would result in the formation of an undulate socket which would cause multiple flexing of a properly inserted sheet. Also, the members *c, d* and *e* need not be completely cylindrical, e.g., these members can have flats facing away from the socket for one more more flexible sheets *g*. Furthermore, the members *c* and *e* may have a polygonal outline. Still further, the diameters of the members *c* and *e* can increase in a direction toward the base if the diameter of the member *d* decreases in a direction away from the base, or vice versa. If desired, at least one of the members *c* to *e* (e.g., the member *d*) can be adjustably mounted on the base *a* so as to change the configuration of the socket for the purpose of properly holding relatively stiff or readily flexible sheets.

Figure 3:
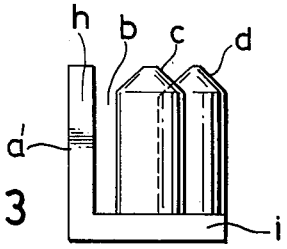
FIG. 3 is a side elevational view of another embodiment of the device.
Figure 4:
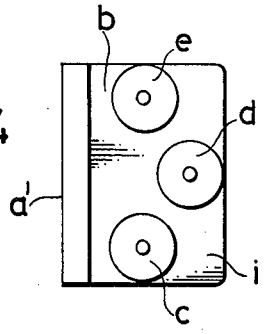
FIG. 4 is a top plan view of the device shown in FIG. 3.

Turning now to the embodiment illustrated in FIGS. 3 and 4, it will be seen that members *c, d* and *e* are mounted on a rectangular base or pedestal. The pedestal is L-shaped in cross section, the horizontal base portion *i* of which serves to support the projections *c, d* and *e*, and the vertical portion *a'* of which serves as one wall portion bounding the channel *b*. The other opposing wall portion bounding channel *b* is provided by the rear surfaces of projections *c* and *e* which are not contacted by a sheet *g*.

The display surface on the portion *a'* of the pedestal is used for exhibiting display material, as described in conjunction with FIG. 1.

Figure 5:
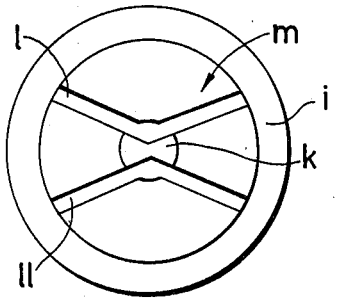
FIG. 5 is a top plan view of still another device.

Turning now to the embodiment of FIG. 5, the base portion *i* of the pedestal is annular, as viewed from above. The wall portions *m* taper upwardly from the base portion *i* to the upper portion *k* and form a truncated cone. In the upper portion *k*, V-shaped sockets or passages *l* and *ll* are provided therein for receiving sheets *g*.

Figure 6:
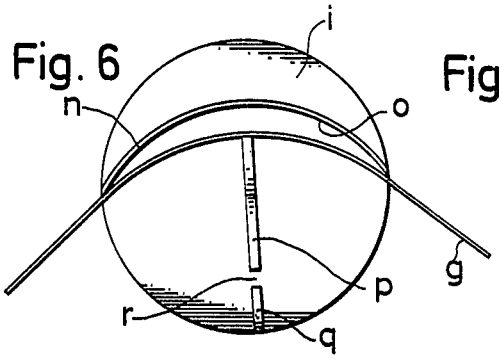
FIG. 6 is a top plan view of a further device.
Figure 7:
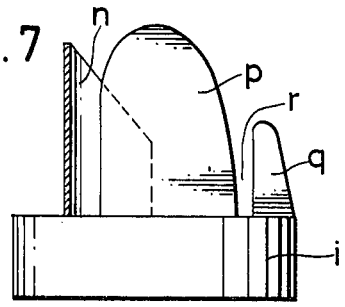
FIG. 7 is a broken-away and partially-sectioned side view of the structure shown in FIG. 6.

Finally, turning to the embodiment of FIGS. 6 and 7, the wall portions or members extend upwardly from the base portion *i* of the cylindrical pedestal.

A U-shaped wall member *n* has a concavely curved contact surface *o* which has spaced sheet-contacting portions located in a common plane on one side of the socket. Opposing member *p* is spaced from the U-shaped member *n* and extends inwardly of the common plane on the other side of the socket, i.e., in the direction into the open side of the U-shaped member *n*.

Adjacent the opposing member *p*, a vane-shaped projection *q* is mounted on base portion *i* which defines a channel *r* for receiving other objects to be held in upright position.

In all of the embodiments mentioned above, the wall portions projecting upwardly from the base are so configurated that they form at least one socket for receiving one or more flexible sheets to be held and displayed, e.g., on an office desk or a table. Typical examples of such sheets are menu cards, price listings, memorandum sheets, checks and paper money; in short, any relatively thin and flexible sheet material which is capable of being easily and repeatedly bent and which is incapable of being self-standing in an upright position by itself.

Insertion of flexible sheets into direct contact with the sheet-contacting surfaces of the respective wall portions maintains and constrains the inserted sheet to remain in deformed condition. By so arcuately shaping a flexible sheet, it is capable of standing stably in the upright position.

The longitudinal channel *b* formed by the additional wall portions is designed for receiving objects which are less stiff and less flexible than a typical flexible paper sheet or the like. Examples of relatively stiff objects are carboard posters, maps, models, filing equipment writing tools and the like.

The device further comprises one or more surfaces (e.g., on the base) for exhibiting display materials which are to be exhibited over longer periods of time as compared with sheets *g* and less flexible objects which are respectively mounted in the socket or sockets and the channel or channels of the display device.

From the above description, it is clear that the display device described herein required very little space and can cheaply be manufactured in various forms. The display device offers practical solutions in fields such as filing and advertising, and especially the restaurant industry.

It will be understood that each of the elements described above, or two or more together, may also find a useful application in other types of constructions differing from the types described above.

While the invention has been illustrated and described as embodied in a sheet-supporting device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for interchangeably supporting sheets in an upright position, particularly for displaying menu cards and the like, comprising a horizontal base and wall portions projecting vertically upwardly from said base and defining three vertically extending sheet-contacting surfaces, said wall portions comprising a first curved wall portion having opposite end portions defining two of said sheet-contacting surfaces located in one plane, the third of said sheet-contacting surfaces being located intermediate said two sheet-contacting surfaces equally spaced from said end portions and displaced in a direction normal to said plane so that a sheet inserted between said sheet-contacting surfaces is flexed and its rigidity increased in the longitudinal direction of the flexure.

2. A device as defined in claim 1, wherein said wall portions comprise a truncated cone and define at least one V-shaped socket.

3. A device as defined in claim 1; and further comprising a display surface for exhibiting display materials.

4. A device as defined in claim 1, wherein said third sheet-contacting surface is constituted by the end portion of the wall portion extending normal to said one plane.

5. A device as defined in claim 1, wherein said first curved wall portion is formed by two cylindrically shaped members each of which defines a respective one of said two sheet-contacting surfaces, said third sheet-contacting surface being formed in an opposing member.

6. A device for interchangeably supporting sheets in an upright position, particularly for displaying menu cards and the like, comprising vertically extending wall portions having sheet-contacting surfaces displaced relative to each other and defining a socket therebetween so that when a sheet is inserted into said socket, the sheet is flexed and its rigidity increased in the longitudinal direction of the flexure, said wall portions comprise a U-shaped curved member having sheet-contacting surfaces located on one side of said socket, and an opposing member having its respective sheet-contacting surface remote from said curved member and located on the other side of said socket.

7. A device for interchangeably supporting sheets in an upright position, particularly for displaying menu cards and the like, comprising a horizontal base; wall portions projecting vertically upwardly from said base and defining only three vertically extending sheet-contacting surfaces, two and said three sheet-contacting surfaces being end surfaces and located in one plane, and the third of said three sheet-contacting surfaces being located intermediate said two end surfaces and offset in a direction normal to said plane so that a sheet is easily inserted between said two end surfaces and said third intermediate surface and is flexed during the insertion so as to increase its rigidity in the longitudinal direction of the flexure to thereby firmly support the sheet between said sheet-contacting surfaces; and additional interconnected wall portions defining a straight socket for relatively rigid flat objects.

* * * * *